US005386597A

United States Patent [19]

O'Neill

[11] Patent Number: 5,386,597

[45] Date of Patent: Feb. 7, 1995

[54] GEOMETRIC FORM-FITTED SPA COVER PROTECTOR

[76] Inventor: John C. O'Neill, 3500 Esperanza Dr., Concord, Calif. 94519

[21] Appl. No.: 84,025

[22] Filed: Jun. 30, 1993

[51] Int. Cl.[6] ..... E04H 4/10

[52] U.S. Cl. ..... 4/498; 4/580

[58] Field of Search ..... 4/498, 503, 580, 494; 150/166

[56] References Cited

U.S. PATENT DOCUMENTS

| | | | |
|---|---|---|---|
| 4,422,192 | 12/1983 | Jacobs | 4/580 |
| 4,589,459 | 5/1986 | Lantrip | 150/166 |
| 4,857,374 | 8/1989 | Perry | 4/498 |
| 5,022,101 | 6/1991 | Gosselin et al. | 4/503 |
| 5,040,252 | 8/1991 | Taggart | 4/580 |
| 5,086,525 | 2/1992 | Christopher | 4/498 |

OTHER PUBLICATIONS

SPA Soks Spa cover protector brochure (no date).

*Primary Examiner*—Henry J. Recla
*Assistant Examiner*—Charles R. Eloshway

[57] ABSTRACT

A geometric form-fitted acrylic spa cover protector composed of two pieces of acrylic cut to a geometric form or shape and sewn together at the edge of the perimeter. The spa cover protector is designed to fit ober any spa cover an protects the spa cover from the effects of outdoor weather conditions.

1 Claim, 1 Drawing Sheet

GEOMETRIC FORM-FITTED SPA COVER PROTECTOR

BACKGROUND AND SUMMARY OF THE INVENTION

This invention relates to hot tubs and spas and hot tub and spa covers. The term hot tub and spa are interchangeable and the use of the term spa is intended to refer to both spas and hot tubs. Hot tubs and spas are generally installed out-of-doors. All spas are constructed in a geometric form or shape. Spa covers are generally upholstered with a flimsy vinyl cover. The spa cover vinyl upholstering is exposed to the deteriorating effects of climatic elements, and they become worn and unsightly. The spa cover protector is made of durable, light-weight material in various decorative colors and geometric shapes consisting of round, rectangle, octagon, and square cuts to fit any spa cover. The spa cover protector protects the spa cover from the deteriorating effects of the outdoor climatic weather conditions.

DRAWING AND FIGURES

FIG. 1 is a rectangular-shaped spa cover protector with six strategically placed pieces of VELCRO® hook and loop fastener.

FIG. 2 is an octagonal-shaped spa cover protector with six strategically placed pieces of VELCRO® hook and loop fastener.

FIG. 3 is a circular-shaped spa cover protector with six strategically placed pieces of VELCRO® hook and loop fastener.

DESCRIPTION OF THE DRAWINGS:

Figure 1:
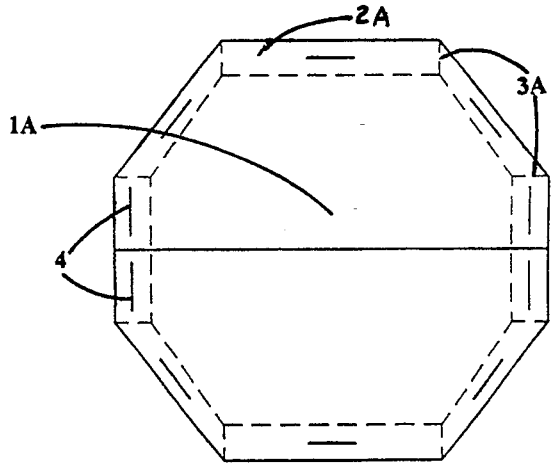
Figure 2:
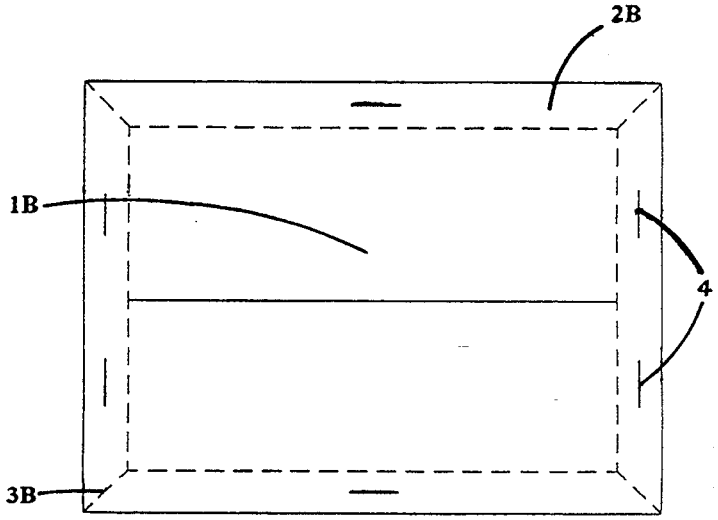
Figure 3:
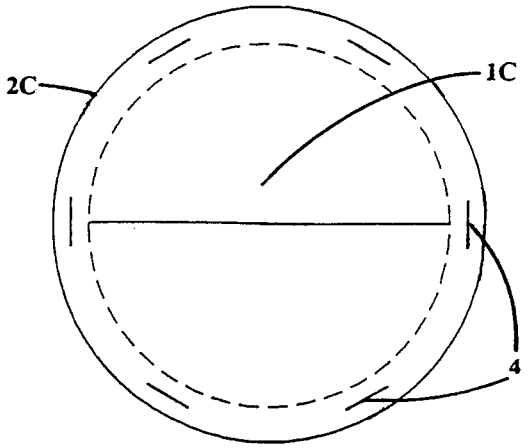

| DRAWING REFERENCE | DESCRIPTION |
|---|---|
| FIG. 1, 2, and 3 | Is a drawing of the cover protector constructed according to this invention. |
| FIG. 1-1A<br>FIG. 2-1B<br>FIG. 3-1C | Is a top view of the top panel of the spa cover protector. |
| FIG. 1-2A<br>FIG. 2-2B<br>FIG. 3-2C | Is a plan view of the side panel of the spa cover protector. This piece, two- to five-inches in width is cut to a length equal to the perimeter of the top surface piece, which is sewn to the surface piece to form the side panels of the spa cover protector. |
| FIG. 1-3A<br>FIG. 2-3B | Is a top view of the corners which are bound by stitching along the edge. |
| FIG. 1-4<br>FIG. 2-4<br>FIG. 3-4 | Is a top view of the side panels to which VELCRO® hook-and-loop fastener strips are attached. A partner piece of the VELCRO® hook-and-loop fastener strips is attached to the underside/interior of the side panel, allowing the spa cover protector to be attached to the spa cover. |

DESCRIPTION OF A PREFERRED EMBODIMENT OF THE INVENTION

The spa cover protector is designed to provide complete protection for the spa cover upholstering from the harsh climatic conditions of outdoor usage. The spa cover protector design will protect the vinyl upholstering spa covers from the heat of the sun, preventing fading, discoloration, and cracking. Each spa cover protector is cut and designed to custom specifications to meet the specific size and particular dimensions of the spa cover being fitted.

The spa cover protectors are constructed from two pieces of durable, light-weight, wear resistant 100% flat acrylic material with a canvas look and feel which are sewn together utilizing a double stitch seam, using bonded texture 70-pound nylon thread for additional strength.

One piece is cut to the size and dimensions of the top surface area of the spa cover and according to the specifications of the particular spa cover being fitted. This piece forms the top of the spa cover protector. A second piece, two- to five-inches in width is cut to a length equal to the perimeter of the top surface piece, which is sewn to the surface piece to form the side panels of the spa cover protector.

One edge of the entire perimeter of the side panels piece is turned under along the entire edge of the piece to form a one-half-inch french felt seam; the seam is sewn along the edge, one-half-inch from the outer perimeter.

The two pieces are sewn together at the outer edges with 70-pound nylon thread using one-half-inch stitches, to form the spa cover protector, with a three- to four-inch side wall as shown in FIGS. 1, 2, and 3.

The comers are bound by stitching along the edge of each comer with 70-pound nylon thread.

Six one-inch by four-inch long VELCRO® hook-and-loop fastener pieces are sewn to the inner side of the spa cover protector side panels for proper fitting on all comers or angles as a fastening and adhesive point.

Each spa cover protector package comes with six pieces of VELCRO® hook and loop fastener which the customer can attach with glue, epoxy, or some other adhesive to strategic corresponding fastening points on the spa cover. The VELCRO® hook-and loop fastener is then attached to the partner piece of VELCRO® on a corresponding point on the underside of the spa cover protector by the customer or installer, firmly holding the spa cover protector in position.

To install the spa cover protector, the spa cover protector is simply placed over the spa cover matching the pre-installed VELCRO® hook-and loop fastener strips on the spa cover to the VELCRO® hook-and-loop fastener strips on the spa cover protector and applying hand pressure to the VELCRO® hook and loop fastener points.

Each spa cover protector is expected to last five (5) years before the fabric becomes unsightly and unusable due to loss of color or strength from normal exposure to out door conditions, including sunlight, mildew, rot, and atmospheric chemicals.

Although the description above contains many specificities, these should not be construed as limiting the scope of the invention but as merely providing illustrations of some of the presently preferred embodiments of this invention. For example, the spa cover protector can have other shapes, such as circular, oval, trapezoidal, triangular, and any other shape or form. The VELCRO® hook-and-loop fastener strips can be attached at different strategic points; thus, the scope of the invention should be determined by the appended claims and their legal equivalents, rather than by the examples given.

DESCRIPTION OF PRIOR ART

There is not a product or cover made specifically for the protection of these spa covers. The spa covers themselves are upholstered in a flimsy and corrodible vinyl and they are subject to the climatic elements, such as heat from the sun, and they become faded, worn, and damaged. The upholstered covering is permanently attached to the spa cover and it is not removable. The vinyl spa cover may become cracked, unsightly, and must be discarded because it cannot easily be removed, washed, or restored; thus, having a very short life span necessitating costly replacement of the vinyl spa cover upholstering.

OBJECT AND ADVANTAGES

Accordingly, besides the objects and advantages of the durable covers described in my above patent, several objects and advantages of the present invention are:

The spa cover protector can be made to fit any spa cover of any geometric size, shape, or form.

The spa cover protector is made of durable light-weight acrylic material, with a canvas look and feel and it is not subject to the climatic elements and can be made of any color to match, complement, or contrast the existing decor and color scheme.

The spa cover protector can withstand the outdoor elements and it does not have to be replaced as often. Replacement of the hot tub cover requires the removal of the entire upholstered covering. Removal of the spa cover upholstering requires tools. The spa cover protector simply requires the unfastening of the VELCRO® hook-and loop fastener strips and lifting the spa cover protector off—leaving the spa cover upholstering intact. No tools are needed to remove the spa cover protector. The spa cover protector is water resistant, quick-drying, stain and fade resistant, windproof, and washable.

The spa cover protector is resistant to the outdoor weather elements and it does not become faded, cracked, or unsightly.

The spa cover protector is made of light-weight material and can be installed, used and removed, and stored easily and conveniently. The spa cover protector is flexible and pliable and it does not have to be removed to open the spa cover and during use of the spa.

I claim:

1. A spa cover protector, for use in combination with a spa cover of any geometric shape, size, or form, said spa cover protector comprising:

a first piece of weatherproof, canvas-like material, having a perimeter, and cut to a geometric shape, so as to correspond to the geometric shape of the spa cover;

a second piece of said material attached to said first piece of said material at said perimeter and extending outwardly therefrom, said second piece being of sufficient length so as to extend around the entire perimeter of said first piece;

a plurality of hook-and-loop type fasteners attached to an interior side of said second piece and arranged to mate with receiving hook-and-loop type fasteners adapted to be mounted on said spa cover, whereby, said spa cover protector effectively encloses said spa cover, protecting said spa cover from adverse climatic conditions and deteriorating due to environmental exposure.

* * * * *